US009335669B2

(12) United States Patent
Lefevre et al.

(10) Patent No.: US 9,335,669 B2
(45) Date of Patent: May 10, 2016

(54) SYSTEMS AND METHODS FOR IMPLEMENTING ADVANCED STRIPPING OF IMAGE RECEIVING MEDIA SUBSTRATES IN IMAGE FORMING DEVICES

(71) Applicant: XEROX Corporation, Norwalk, CT (US)

(72) Inventors: Jason M. Lefevre, Penfield, NY (US); Jack T. Lestrange, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/448,982

(22) Filed: Jul. 31, 2014

(65) Prior Publication Data

US 2016/0033905 A1 Feb. 4, 2016

(51) Int. Cl.
*G03G 15/16* (2006.01)
*G03G 15/00* (2006.01)

(52) U.S. Cl.
CPC ..... *G03G 15/161* (2013.01); *G03G 15/6529* (2013.01); *G03G 15/6532* (2013.01)

(58) Field of Classification Search
CPC ..... G03G 15/161; G03G 15/6529; G03G 15/6532
See application file for complete search history.

(56) References Cited

U.S. PATENT DOCUMENTS

| | | | | | |
|---|---|---|---|---|---|
| 4,062,631 | A * | 12/1977 | Ichikawa et al. | ..... | 399/164 |
| 5,557,389 | A * | 9/1996 | Sato et al. | ..... | 399/315 |
| 5,710,964 | A * | 1/1998 | Tombs et al. | ..... | 399/303 |
| 2011/0299895 | A1 * | 12/2011 | Tsukioka | ..... | 399/322 |

* cited by examiner

*Primary Examiner* — Sandra Brase
(74) *Attorney, Agent, or Firm* — Ronald E. Prass, Jr.; Prass LLP

(57) ABSTRACT

A system and method are provided implementing advanced stripping of image receiving media substrates, including substrates involved in any cut-sheet image forming process in an image forming device that includes a pressure nip necessitating an ability to reliably remove the sheets of image receiving media substrate from a conformable belt and/or roller surface. An appropriate peel force is applied to and opposite side of the image receiving media substrate that effectively peels an image receiving media substrate and image combination from an intermediate transfer belt downstream of a conformable transfer nip. A relatively small diameter stripper roller is positioned downstream of, and in close proximity to, the conformable transfer nip as an apparatus by which to effect application of the appropriate peel force. The small diameter stripper roller has a contact surface formed of an appropriately tacky material, including certain silicone materials, to apply the peel force.

19 Claims, 3 Drawing Sheets

SYSTEMS AND METHODS FOR IMPLEMENTING ADVANCED STRIPPING OF IMAGE RECEIVING MEDIA SUBSTRATES IN IMAGE FORMING DEVICES

BACKGROUND

1. Field of the Disclosed Embodiments

This disclosure relates to systems and methods for implementing advanced stripping of image receiving media substrates, including and particularly those substrates involved in any cut-sheet image forming process in an image forming device that includes a pressure nip necessitating an ability to reliably remove the sheets of image receiving media substrate from a conformable belt and/or roller surface.

2. Related Art

Modern image forming devices process nearly countless combinations of compositions of image receiving media and image marking materials for forming images on those image receiving media. It is well recognized in the image forming arts that certain combinations of compositions of the image receiving media and image marking materials introduce particular issues with regard to the image receiving medium handling. For example, in a transfix aqueous inkjet process, an intermediate transfer belt is employed onto which a digital image will be printed using aqueous ink jet print heads. Before the aqueous ink is jetted onto the surface of the intermediate transfer belt, a liquid solution is deposited and dried on the intermediate transfer belt. This liquid solution layer may commonly be referred to as a "skin" layer. The skin layer may primarily consist of a combination of a starch, a surfactant and water.

The skin layer may be applied to the intermediate transfer belt in preparation for the application (jetting) of the aqueous ink on the surface of the intermediate transfer belt in an aqueous ink jetting process to develop the digital image on the intermediate transfer belt. The skin layer facilitates the jetted aqueous ink wetting on the surface of the intermediate transfer belt. The digital image is then produced by jetting the aqueous ink onto the skin layer. The thus-formed aqueous ink jet digital image, including the skin layer according to this process, is then dried to form a transferable digital image on the skin covered surface of the intermediate transfer belt.

The intermediate transfer belt, with the transferrable digital image formed thereon, may then be passed through a conformable transfer nip comprised of an external pressure roller and an internal pressure roller that sandwich the intermediate transfer belt therebetween. Image receiving media substrates, in cut-sheet form, are introduced to the transferrable digital image transfer process at the at the conformable transfer nip where the transferrable digital image consisting of the dried film of jetted aqueous ink and the skin layer is transferred from the intermediate transfer belt to the image receiving media substrates.

One of a number of challenges in effectively employing this process, and other like processes, occurs at the point of the transfer of the transferrable digital image to the image receiving media substrate. Based on a tackiness of the skin layer, the dried film of skin and aqueous ink jet image adheres to the intermediate transfer belt. Additionally, the cut-sheet image receiving media substrate sticks firmly to the dried film, which is adhered to the intermediate transfer belt. The dried film generally extends completely toward, or to, the edges of the image receiving media substrate, regardless of how much of the surface of the image receiving media substrate may receive the actual image. As such, even the leading edge of the image receiving media substrate, with the dried film and image formed thereon, is adhered to the intermediate transfer belt in a manner that renders ineffective certain conventional techniques, methods and system components that are generally employed for stripping cut-sheets of image receiving media substrate from the intermediate transfer belt at an exit of the conformable transfer nip. An air knife, for example, may be generally ineffective because of the strict adherence of the leading edge of the cut-sheet image receiving media to the intermediate transfer belt. In other words, the air knife tends to only be effective in instances in which a leading edge of the image receiving media substrate may lift slightly so as to provide at least a minimal gap between the intermediate transfer belt and the image receiving media substrate. Because the skin goes all away to the edge of the image receiving media, no gap is generally formed at that point.

A relatively well-known type of media handling technology that may be usable to address the leading edge adhering problems associated with certain image receiving media/image marking media combinations involves an adaptation of a technique used in the offset printing industry by employing mechanical "gripper bars." The adapted technique employs mechanical gripper bar components to physically clamp at least the leading edge (and sometimes the trailing edge) of each sheet of image receiving media generally to drum components in the image receiving media transport path as the sheets of image receiving media are passed through the conformable transfer nip. This positive mechanical control of the leading edge of the individual sheets of image receiving media is intended to ensure that a positive "stripping" force is applied to the individual sheets of image receiving media downstream of the conformable transfer nip to peel the individual sheets of image receiving media away from, for example, a surface of an intermediate transfer belt.

Employment of gripper bars is, however, not without its drawbacks. For example, a fairly major limitation of the gripper bar approach is that devices applying this approach are limited to a fixed pitch. In other words, the spacing of the gripper-bars as mechanical components in the image receiving media transport path is fixed (not variable) to accommodate a maximum image receiving media sheet length in the process direction. This fixed pitch characteristic reduces efficiency in the image forming devices within which this approach is employed, for example, when the image forming device is used to form images on sheets of image receiving media that are smaller, and in cases significantly smaller, in length than the maximum image receiving media sheet length that defines the necessary spacing for the gripper bars, resulting in significant productivity loss. The productivity loss is measurable and particularly proportional to the difference between the maximum image receiving media sheet length and the shorter image receiving media sheet length that is being processed at any given time. Additionally, gripper bar and drum assemblies tend to be very expensive and comparatively large, both of which characteristics tend to be prohibitive for the High-End Cut Sheet or HECS devices and product space. Finally, gripper bar technologies, by their very nature, preclude printing all the way to an edge of the image receiving media substrate, which may preclude the digital image and skin combinations described above.

SUMMARY OF DISCLOSED SUBJECT MATTER

Experimentation was undertaken in view of the shortfalls in conventional systems described above to determine and/or characterize a peel force needed to mechanically peel the image receiving media substrate with the digital image and skin formed thereon from the intermediate transfer belt. It was determined that if that peel force could be amply applied to an opposite face of the image receiving media substrate, such application of a peel force may overcome the adhering force of the image receiving media substrate/skin and image to the intermediate transfer belt.

It would be advantageous in view of the above-indicated issues to provide a unique system, technique, method and/or process for stripping the ink/skin/media combination from the intermediate transfer belt surface post-transfer, downstream of the conformable transfer nip in a process direction.

Exemplary embodiments of the systems and methods according to this disclosure may apply an appropriate peel force to and opposite side of the image receiving media substrate that may effectively peel the image receiving media substrate/skin and image combination from the intermediate transfer belt downstream of the conformable transfer nip.

Exemplary embodiments may employ a small diameter stripper roller positioned downstream of, and in close proximity to, the conformable transfer nip as an apparatus by which to effect application of the appropriate peel force.

Exemplary embodiments may employ a small diameter stripper roller having a contact surface formed of an appropriately tacky material, including certain silicone materials, to apply the above-indicated peel force to the opposite side of the image receiving media substrate to overcome the adherence force of the image receiving media substrate/skin and image combination to the intermediate transfer belt.

Exemplary embodiments may advantageously employ a small diameter stripper roller as a preferable mechanism to effect sheet stripping over, for example, the more expensive and complicated gripper bar mechanisms that are conventionally employed to effect control and stripping of sheet media downstream of a conformable transfer nip.

In exemplary embodiments, the stripper roller may have a comparatively smaller diameter in order to create a larger local stripping angle where the stripper roller forms a nip with the intermediate transfer belt threaded around the internal pressure roller downstream of the conformable transfer nip. Put another way, a rate of separation of the image receiving media substrate may increase with a decrease in a diameter of the stripper roller. The stripper roller may also have a comparatively small diameter in order to be more easily physically accommodated within the image receiving media transport path as an additional element.

Exemplary embodiments may employ conventional stripper ribs or fingers to, in turn, strip the individual sheets of image receiving media from the tacky surface of the small diameter stripper roller.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for implementing advanced stripping of image receiving media substrates, including and particularly those substrates involved in any cut-sheet image forming process in an image forming device that includes a pressure nip necessitating an ability to reliably remove the sheets of image receiving media substrate from a conformable belt and/or roller surface, will be described, in detail, with reference to the following drawings, in which.

DETAILED DESCRIPTION OF THE DISCLOSED EMBODIMENTS

Figure 1:
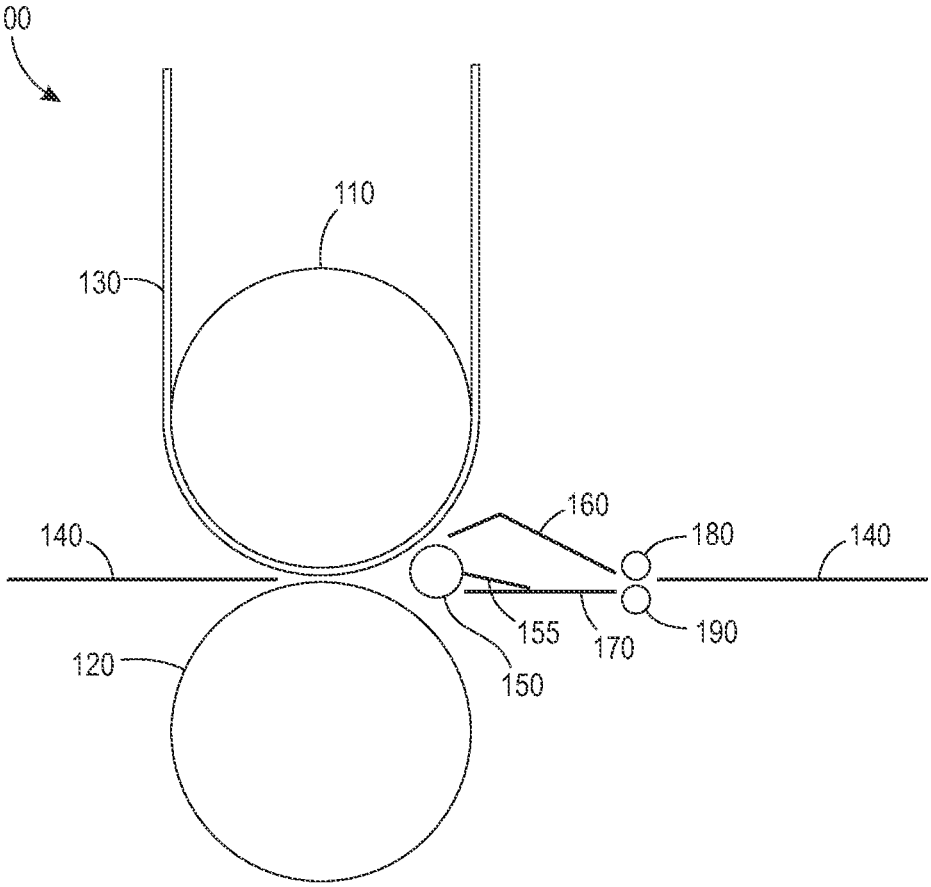
FIG. 1 illustrates a schematic diagram of an exemplary embodiment of an image receiving media transport system for effecting transport and stripping of an image receiving media substrate in an image forming device according to this disclosure.

The systems and methods for implementing advanced stripping of image receiving media substrates, including and particularly those substrates involved in any cut-sheet image forming process in an image forming device that includes a pressure nip necessitating an ability to reliably remove the sheets of image receiving media substrate from a conformable belt and/or roller surface according to this disclosure will generally refer to these specific utilities for those systems and methods. Exemplary embodiments described and depicted in this disclosure should not be interpreted as being specifically limited to any particular configuration an imaging system, an image receiving media transport system in an image forming device, or according to any other like limitation. It should be recognized that any advantageous use of the system and methods for applying a tacky surface of a small diameter stripper roller positioned downstream in a process direction of a conformable transfer nip or a fusing nip in an image forming device that may facilitate stripping of a sheet of image receiving media from a belt or drum unit to which the sheet of image receiving media may adhere is contemplated.

The systems and methods according to this disclosure will be described as being particularly adaptable to use for image receiving media transport in image forming devices. These references are meant to be illustrative only in providing a single real-world utility for the disclosed systems and methods, and should not be considered as limiting the disclosed systems and methods to any particular product or combination of devices, or to any particular type of image forming device in which the described and depicted image receiving media transport systems may be used. Any commonly-known processor-controlled image forming device in which the processor may direct movement of any selected image receiving media along a transport path for the image receiving media that includes, in at least one portion, a tacky surface small diameter stripper roller that may be adapted according to the specific capabilities discussed in this disclosure is contemplated.

The disclosed embodiments replace an air knife or other conventional post nip stripping component with a post-transfer conformable stripper roller that enables a stripping force greater than the forces present between an intermediate transfer belt (or drum) and a sheet of image receiving media that may otherwise adhere to the image transfer belt. In embodiments that small diameter stripper roller may have a surface formed of a suitable tacky material. One example of such a material is RT622 silicone~2 mm thickness, 10% $Fe_2O_3$) coated with G621—Viton (0.2-0.3 mm thickness. The small diameter stripper roller, thus coated, may apply a stripping force to a sheet of image receiving media downstream of a processing nip to strip the sheet of image receiving media from the intermediate transfer belt or drum to which, for example, the image receiving media with a skin layer and/or an image formed thereon may adhere.

The disclosed post-transfer conformable small diameter stripper roller may create a nip with the intermediate transfer belt or drum and may engage the intermediate transfer belt or drum just prior to (~5 mm prior) the image receiving media entering this "stripping" nip. The post-transfer conformable small diameter stripper roller may then disengage the nip at a point just after the trail edge of the media has left the "stripping" nip. Thin stripping ribs may be interspaced between much larger sections of this post-transfer conformable small diameter stripper roller to enable the image receiving media, after the image receiving media has been stripped from the intermediate transfer belt or drum by the small diameter stripper roller, to then be stripped away from the small diameter stripper roller and returned to the image receiving media transport path via, for example, nipped drive rollers.

In experimentation, stripping forces were characterized for certain ink and/or skin layer combinations adhering to an intermediate transfer belt, as well as the stripping forces needed for a post-transfer conformable small diameter stripper roller to peel away a sheet of image receiving media having the ink and/or skin layer combination disposed thereon from intermediate transfer belt to which the sheet of image receiving media is thus adhered. It was found that the force to strip favored a configuration of a post-transfer conformable "tacky" surface small diameter stripper roller, supporting a capacity by which the stripping force may overcome the adhesion of the ink/skin to the intermediate transfer belt surface and provide a reliable means of repeatedly stripping image receiving media in a manner that does not damage the image receiving media or any ink images and/or skin layer formed thereon.

The disclosed embodiments may be particularly employed in commercial aqueous ink jet printing (also referred to as drop-on-demand) as this industry sector continues to represent an area of growth as customers and printing equipment manufacturers continue to realize the value of personalized digital content. Any implementation of a transfix aqueous ink-jet business may benefit from the disclosed techniques for implementing a robust means of media stripping.

The disclosed embodiments may allow the marking engine in an image forming device to run all paper lengths at process speed (an often important metric or capability). This capability would represent a major advantage over known gripper bar solutions to media stripping. The gripper bar approach, as noted above, is a fixed pitch solution implemented through devices in which the spacing of the gripper-bars on the transport drums is designed for a maximum sheet length (in the process-direction). When a machine is used to print on sheets smaller in length than what the gripper bars were designed for results in productivity loss (proportional to the difference between the maximum sheet length and the sheet length being processed at the time).

The disclosed embodiments propose and involve proposed hardware designs that are far more compact than gripper bar approaches because the circumference of the cylinders to which gripper bars are mounted must be equal-to or larger than the length of the longest sheet-length that the image forming system with which the gripper bar approach is associated. For example, in a "B2" capable press, the maximum process length dimension of the image receiving media is 500 mm. Therefore, the impression cylinder (and subsequent transport drums in the process) must all be 160 mm or larger in diameter. In contrast to the above-noted size constraints in gripper bar systems, the tacky small diameter stripper roller designs according to this disclosure may be on the order of as small as 25-50 mm in diameter. Also, gripper bar and drum/belt image receiving media transport systems may be considered cost prohibitive in the HECS market segment.

As is well known in the art gripper bars are essentially a series of mechanical fingers that clamp down on the edge of a sheet (generally within 2-5 mm of the edge). These bars are attached circumferentially to transport drums or may be spaced along a transport belt in a printing press. The state (clamped or released) of these mechanical fingers is timed such that sheets of image receiving media are positively controlled along at least a portion of the transport path. In certain implementations this requires a very precise timing to effect hand offs from one drum or other transport component to another until the sheet of image receiving media is passed entirely through a particular image forming and finishing system. In general, gripper bar sheet transport systems for use in image forming/processing devices are well known (see, e.g., U.S. Pat. No. 5,177,541 to Castelli et al., commonly-assigned) and will not be further described here.

FIG. 1 illustrates a schematic diagram of an exemplary embodiment of an image receiving media transport system 100 for effecting transport and stripping of an image receiving media substrate 140 in an image forming device according to this disclosure. As shown in FIG. 1, the exemplary media transport system 100 may generally include a combination of components that collectively form a pressure nip. The pressure nip may be formed as an internal pressure roller 110 and an external pressure roller 120 that sandwich or otherwise compress an intermediate transfer belt 130 therebetween.

In embodiments, a thin film that may include at least one of a dried ink and a skin layer may be applied to a surface of the intermediate transfer belt 130 prior to passing that surface of the intermediate transfer belt 130 through the pressure nip. Individual sheets of image receiving media substrate 140 may be positioned to pass through the pressure nip. As the individual sheets of image receiving media substrate 140 are brought into contact with the thin film on the surface of the intermediate transfer belt 130 in the pressure nip. The intent of this interaction, as is well known, is to facilitate transfer of the thin film from the surface of the intermediate transfer belt 130 to the surface of the individual sheets of image receiving media substrate 140. This interaction, however, often causes the individual sheets of image receiving media substrate to follow a con tour of the intermediate transfer belt 130 around the internal pressure roller 110 downstream of the pressure nip in a process direction in the image forming device. Often, this phenomenon occurs based on the adhesion factors in the thin film that cause the thin film, as transferred, to act as a type of adhesive to generally hold the individual sheets of image receiving media substrate 140 in contact with the surface of the intermediate transfer belt 130.

The exemplary media transport system 100 may include at least one post-transfer conformable roller assembly 150 positioned immediately downstream of the pressure nip in a process direction. The at least one post-transfer conformable roller assembly 150 may be formed of, or coated with, a material that causes the at least one post-transfer conformable roller assembly to have the tacky surface. Suitable materials may include any material that may adhere to the non-image side of the individual sheets of image receiving media substrate 140 in a manner to cause a positive stripping force to be applied to the individual sheets of image receiving media substrate 140, the stripping force overcoming the adhesion forces which hold the individual sheets of image receiving media substrate 140 to the intermediate transfer belt 130. The suitable materials may include, for example, RT622 silicone~2 mm thickness, 10% $Fe_2O_3$ coated with G621—Viton (0.2-0.3 mm thickness). It should be noted that this is a non-limiting example of a particular experimentally derived combination of material.

As the individual sheets of image receiving media 140 exit the pressure nip in a manner that the individual sheets may now be at least partially adhered to the intermediate transfer belt 130, the individual sheets of image receiving media 140 may be transported by this adherence to the intermediate transfer belt 130 a stripper nip formed between the at least one post-transfer conformable roller assembly 150 in contact with the surface of the intermediate transfer belt 130. A tacky nature of the surface of the at least one post-transfer conformable roller assembly 150 causes contact with a non-image bearing side of the image receiving media 140 to be pulled from adherent contact with the surface of the intermediate transfer belt 130.

In embodiments, an actuating mechanism (which will be described in greater detail below) may allow a tacky-surface roller of the at least one post-transfer conformable roller assembly 150 to engage the intermediate transfer belt just prior to (e.g., within 5 mm) the individual sheets of image receiving media 140 entering the stripping nip. In such configurations, the actuating mechanism may subsequently be operated to disengage the at least one post-transfer conformable roller assembly 150 at a point just after a trailing edge of the individual sheets of image receiving media 140 have individually left the stripping nip. A stripper assembly 155 may be positioned in contact with the at least one post-transfer conformable roller assembly 150 in a form, for example, of thin ribs will be interspaced between much larger sections of the at least one post-transfer conformable roller assembly 150 to enable the individual sheets of image receiving media 140, after having been stripped from the intermediate transfer belt 130, to then be stripped away from the at least one post-transfer conformable roller assembly 150 between, for example, an upper stripping guide 160 and a lower stripping guide 170. The individual sheets of image receiving media 140 may then be moved farther downstream in a process direction and/or returned to, for example, the image receiving media past toward a finishing, post-processing, or output, component in the image forming device by being passed through one or more pairs of exit pinch rollers 180, 190 constituting an exit pinch nip.

Figure 2:
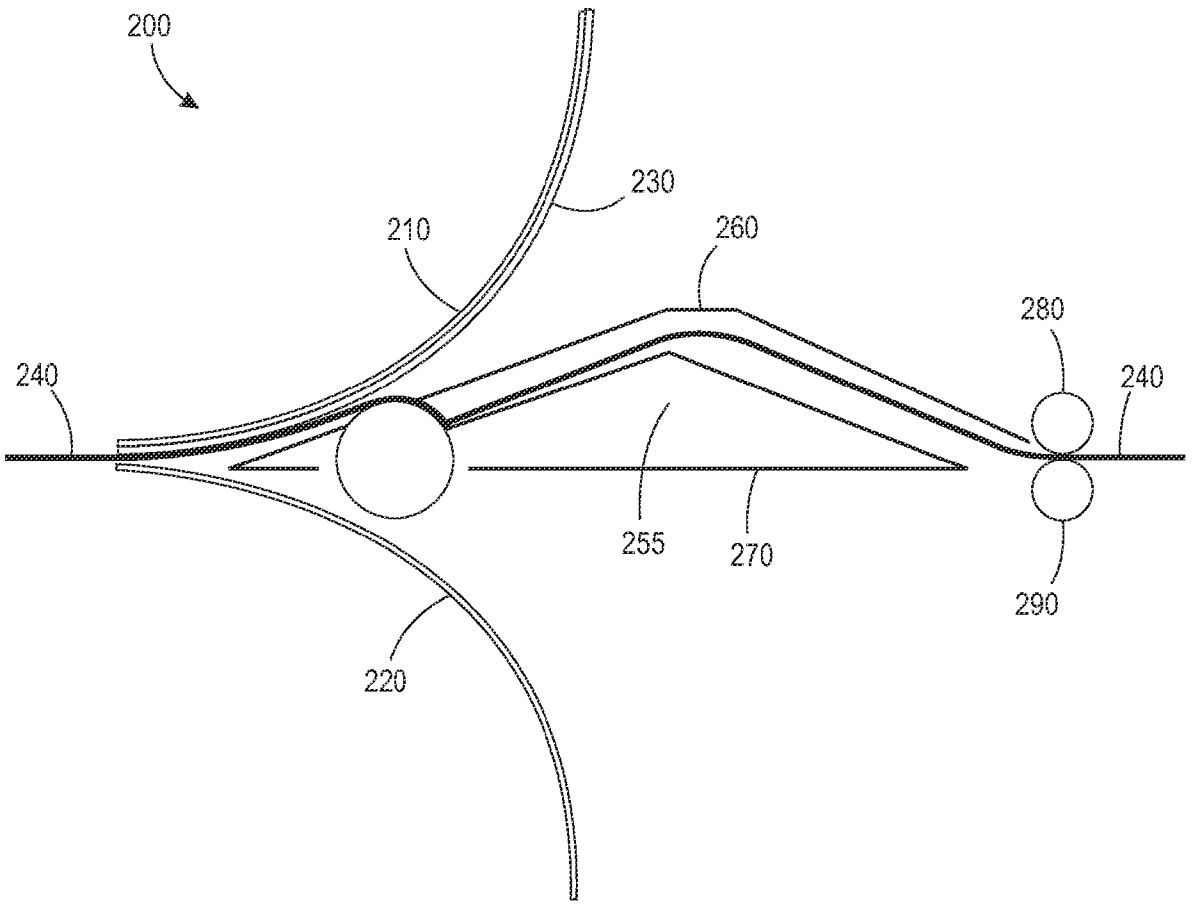
FIG. 2 illustrates a more detailed schematic diagram of the exemplary embodiment of the image receiving media transport system shown in FIG. 1 for effecting transport and stripping of the image receiving media substrate in the image forming device according to this disclosure.

FIG. 2 illustrates a more detailed schematic diagram of the exemplary embodiment of the image receiving media transport system 200 shown in FIG. 1 for effecting transport and stripping of the image receiving media substrate in the image forming device according to this disclosure. As shown in FIG. 2, the exemplary media transport system 200 may generally include a combination of components that collectively form a pressure nip. The pressure nip may be formed as an internal pressure roller 210 and an external pressure roller 220 that sandwich or otherwise compress an intermediate transfer belt 230 therebetween. It should be noted that a numbering convention in FIG. 2 is intended to replicate the numbering convention in FIG. 1 for continuity and ease of understanding of the disclosed concepts.

Individual sheets of image receiving media 240 passing through the pressure nip and having images formed thereon will tend to cause causes the individual sheets of image receiving media 240 to follow a contour of the intermediate transfer belt 230 around the internal pressure roller 210 downstream of the pressure nip in a process direction in the manner shown in FIG. 2.

At least one post-transfer conformable roller assembly may be positioned immediately downstream of the pressure nip in the process direction. The at least one post-transfer conformable roller assembly may have a surface material that causes the at least one post-transfer conformable roller assembly to have the tacky surface. Suitable materials and appropriate characteristics of those suitable materials are discussed in some detail above. An objective is that interaction between the at least one post-transfer conformable roller assembly and a non-image side of the individual sheets of image receiving media substrate 240 will exert a positive stripping force on the individual sheets of image receiving media substrate 240, to cause those individual sheets of image receiving media substrate 240 to be pulled away from adherence to the intermediate transfer belt 230 as the stripping force exerted by the at least one post-transfer conformable roller assembly overcomes any adhesion forces which hold the individual sheets of image receiving media substrate 240 to the intermediate transfer belt 230.

As the individual sheets of image receiving media 240 exit the pressure nip in a manner that the individual sheets of image receiving media 240 may now be at least partially adhered to the intermediate transfer belt 230, the individual sheets of image receiving media 240 may be transported by this adherence to the intermediate transfer belt 230 to a stripper nip formed between the at least one post-transfer conformable roller assembly and contact with the surface of the intermediate transfer belt 230. A tacky nature of the surface of the at least one post-transfer conformable roller assembly causes contact with a non-image bearing side of the image receiving media 240 to be pulled from adherent contact with the surface of the intermediate transfer belt 230 in a manner generally as shown in FIG. 2. A relatively smaller diameter of the at least one post-transfer conformable roller assembly with respect to a diameter of the internal pressure roller 210 about which the intermediate transfer belt 230 is threaded may cause an increase in an angle, i.e., a stripper angle, formed between the surface of the intermediate transfer belt 230 and the at least one post-transfer conformable roller assembly.

In embodiments, an actuating mechanism is provided to allow a tacky-surface roller of the at least one post-transfer conformable roller assembly to selectively be engaged with, and disengage from, the intermediate transfer belt 230 to form the stripping nip only when appropriate to cause stripping to occur. For example, the actuating mechanism may move the at least one post-transfer conformable roller assembly into contact with the intermediate transfer belt 230 only as an individual sheet of image receiving media 240 approaches a position of the stripping nip, e.g., when the leading edge of the image receiving media 240 may be within 5 mm of the position of the stripping nip. The actuating mechanism may subsequently be operated to disengage the at least one post-transfer conformable roller assembly at a point just after a trailing edge of the individual sheet of image receiving media 240 exits the stripping nip.

A stripper assembly 255 may be positioned in contact with the at least one post-transfer conformable roller assembly. The stripper assembly 255 may take the form of, for example, of a plurality of thin stripper ribs interspaced between much larger sections of the at least one post-transfer conformable roller assembly. The interaction of the stripper assembly 255 with the at least one post-transfer conformable roller assembly may enable the individual sheets of image receiving media 240, after having been stripped from the intermediate transfer belt 230, to then be stripped away from the at least one post-transfer conformable roller assembly between, for example, an upper stripping guide 260 and a lower stripping guide 270.

The individual sheets of image receiving media 240 may then be moved farther downstream in a process direction and/or returned to, for example, the image receiving media path toward a finishing, post-processing, or output, component in the image forming device by being passed through one or more pairs of exit pinch rollers 280,290 constituting an exit pinch nip.

Figure 3:
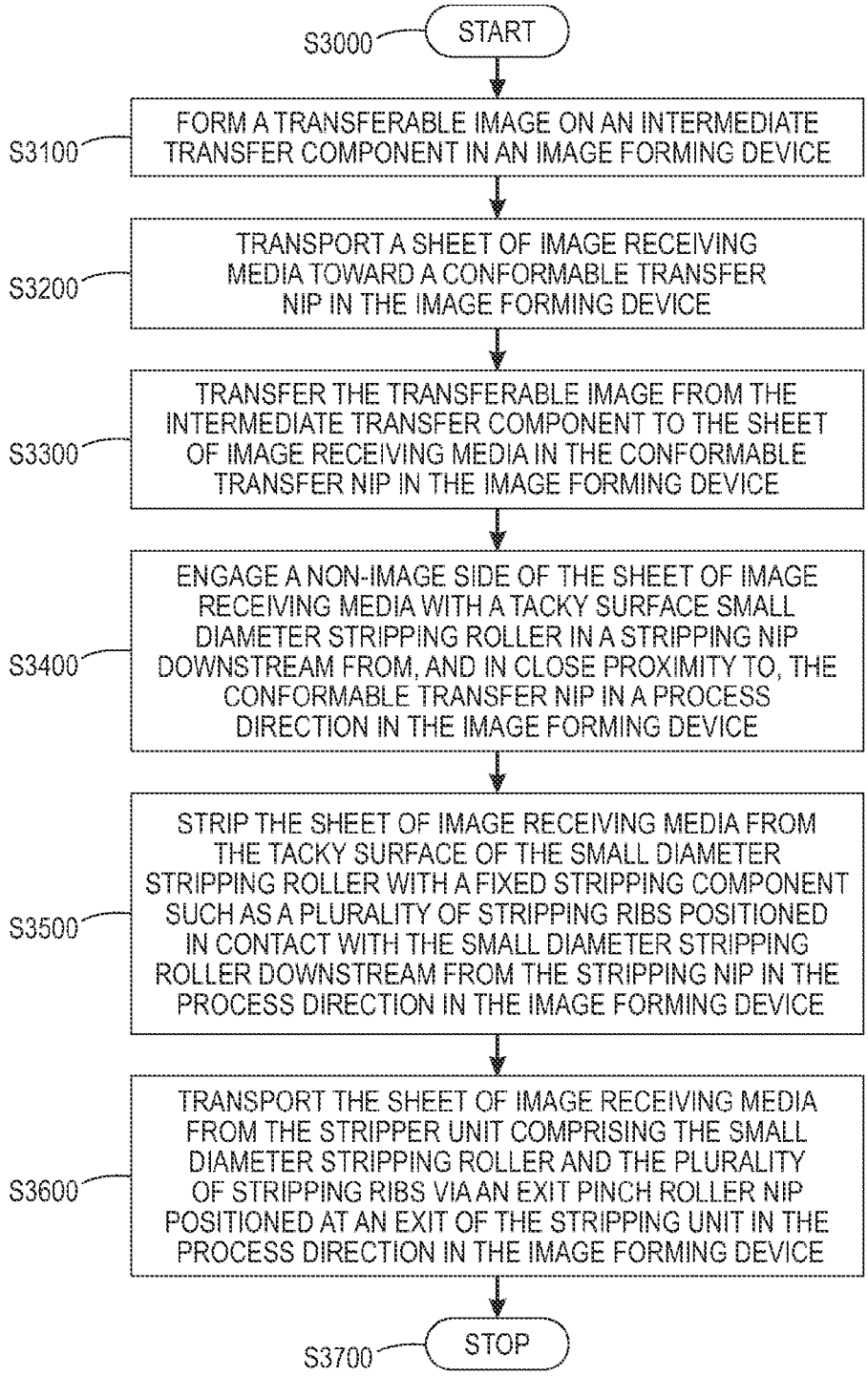
FIG. 3 illustrates a flowchart of an exemplary method for implementing transport and stripping of an image receiving media substrate in an image forming device according to this disclosure.

The disclosed embodiments may include an exemplary method for implementing transport and stripping of an image receiving media substrate in an image forming device. FIG. 3 illustrates a flowchart of such an exemplary method. As shown in FIG. 3, operation of the method commences at Step S3000 and proceeds to Step S3100.

In Step S3100, a transferable image may be formed on an intermediate transfer component in an image forming device. The intermediate transfer component may be in the form of an intermediate transfer belt or an intermediate transfer drum on which transferable images may be formed in the image forming device. Operation of the method proceeds to Step S3200.

In Step S3200, a sheet of image receiving media may be transported from an image receiving media input component toward a conformable transfer nip in the image forming device. Operation of the method proceeds to Step S3300.

In Step S3300, the transferable image may be transferred from the intermediate transfer component to the presented sheet of image receiving media in the conformable transfer nip in the image forming device. It is recognized that the transfer of the transferable image from the intermediate transfer component to the presented sheet of image receiving media may cause the sheet of image receiving media, with the image formed thereon, to follow an outer profile of the intermediate transfer component based on an adhesion of the image marking materials to the intermediate transfer component. Operation of the method proceeds to Step S3400.

In Step S3400, a non-image side of the sheet of image receiving media may be engaged with a tacky surface of a small diameter stripping roller in a stripping nip that may be selectively formed between the small diameter stripping roller and the surface of the intermediate transfer component downstream from, and in close proximity to, the conformable transfer nip in the image forming device. As is described in some detail above, the material for forming the small diameter stripping roller, or at least a surface of the small diameter stripping roller may be selected to ensure that the tacky nature of the surface of the small diameter stripper roller exerts such a stripping force on the non-image side of the sheet of image receiving media so as to overcome any adherence force is between the image-bearing side of the sheet of image receiving media and the intermediate transfer component. Operation of the method proceeds to Step S3500.

In Step S3500, the sheet of image receiving media may be stripped from the tacky surface of the small diameter stripping roller with a fixed stripping component. The fixed stripping component may include, for example, a plurality of stripping ribs positioned in contact with the small diameter stripping roller at a position downstream of the stripping nip in the process direction. It should be noted, however, that such fixed stripping members may not be employable in contact with, for example, the intermediate transfer component because a variance in the transfer efficiency, and therefore image quality, across a span of the intermediate transfer component at the pressure nip would result. Operation of the method proceeds to Step S3600.

In Step S3600, the sheet of image receiving media having been stripped from the tacky surface the small diameter stripping roller may be directed the one or more structural components in a downstream process direction. Transport of the sheet of image receiving media from the stripper unit, which may be considered to comprise the small diameter stripping roller and the plurality of stripping ribs, may be accomplished via, for example, an exit pinch roller nip formed between at least one pair of exit pinch rollers downstream of the other enumerated stripping operations in the image forming device. It should be noted that the at least one pair of exit pinch rollers may be positioned to direct the individual sheets of image receiving media to one or more of a finishing device, post-processing device, or an output component from the image forming device. Operation of the method proceeds to Step S3700, where operation of the method ceases.

As indicated above, the method may positively provide a previously unachievable level of stripping force to remove the sheet of image receiving media from adherence to a surface of an intermediate transfer component based on an adhesive nature of components disposed on a surface of the image receiving media with the intermediate transfer component.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable operating and image forming environments in which the subject matter of this disclosure may be implemented for familiarity and ease of understanding. Although not required, embodiments of the disclosure may be provided, at least in part, in a form of hardware circuits, firmware, or software computer-executable instructions to instruct the specific functions described in image forming devices. These may include individual program modules executed by a processor.

Those skilled in the art will appreciate that other embodiments of the disclosed subject matter may be practiced in devices, including image forming devices, of many different configurations.

The exemplary depicted sequence of executable instructions, or associated data structures that may execute the instructions, represent one example of a corresponding sequence of acts for implementing the functions described in the steps of the above-outlined exemplary method. The exemplary depicted steps may be executed in any reasonable order to effect the objectives of the disclosed embodiments. No particular order to the disclosed steps of the method is necessarily implied by the depiction in FIG. 3, except where a particular method step is a necessary precondition to execution of any other method step.

By way of recap, this disclosure proposes a tacky surface post-transfer conformable roller. The tacky surface of this roll may be, in an exemplary embodiment, comprised of RT622 silicone in approximately a 2 mm thickness that may be further coated with G621—Viton of a 0.2-0.3 mm layer thickness, as a means of stripping the individual sheets of image receiving media from an intermediate transfer belt surface.

An actuating mechanism may selectively move the post-transfer conformable roller to engage and dis-engage the intermediate transfer belt just prior to (within approximately 5 mm of) the individual sheets of image receiving media entering the stripping nip formed by the post-transfer conformable roller and the intermediate transfer belt. The post-transfer conformable roller may dis-engage the nip at a point just after the trail edge of the individual sheets of image receiving media has exited the stripping nip.

Thin ribs may be spaced periodically along a cross-process direction of the post-transfer conformable roller to facilitate media removal from the tacky surface of the post-transfer conformable roller.

The disclosed embodiments may advantageously allow marking engines to run all paper lengths at process speed. This capability is considered a significant plus and represents an advantage over gripper bar solutions to media stripping for the reasons outlined in detail above. Additionally, hardware designs appropriate to implement the disclosed schemes tend to be far more compact than those designs implementing the gripper bar approaches as a circumference of a cylinder, or a length of a belt, to which gripper bars are mounted, which must provide for a gripper bar spacing that is equal-to or greater than the length of the longest sheet-length that is intended to be run by the image forming device implementing the gripper bar approach.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

We claim:

1. A system for transporting image receiving media in an image forming device, comprising:

an imaging member;

an opposing member, the opposing member exerting a force on the imaging member to form a transfer nip in which images formed on the imaging member are transferred to a first surface of an image receiving media substrate introduced into the transfer nip;

a stripper roller positioned downstream of the transfer nip in a process direction, the stripper roller (1) forming a stripping nip through interaction with the imaging member, and (2) exerting a peeling force on the image receiving media by contact with a second surface of the image receiving media, the second surface of the image receiving media being opposite to the first surface;

a mechanical component that moves the stripper roller between a first position and a second position, the first position being in contact with the imaging member to form the stripping nip and the second position opening contact between the stripper roller and the imaging member; and at least one stripping device in physical contact with the stripper roller downstream of the stripping nip in the process direction to strip the image receiving media from contact with the stripper roller, the at least one stripping device comprising a plurality of stripping ribs interspaced along a span-wise length of the stripper roller.

2. The system of claim 1, the imaging member being an imaging belt, the imaging belt being threaded around an internal pressure roller, and the opposing member being an external pressure roller that is in contact with the imaging belt to form the transfer nip by sandwiching the imaging belt between the internal pressure roller and the external pressure roller.

3. The system of claim 2, the stripper roller having a diameter that is less than a diameter of the internal pressure roller.

4. The system of claim 1, the stripper roller having a diameter in a range of 25-50 mm.

5. The system of claim 1, at least a surface of the stripper roller being formed of a material that exerts the peeling force to overcome an adhering force of the image receiving media substrate to the imaging member downstream of the transfer nip in the processing direction.

6. The system of claim 5, the at least the surface of the stripper roller being formed of a silicone material.

7. The system of claim 1, further comprising a pair of exit nipped drive rollers positioned downstream of the at least one stripping device in the process direction to transport the image receiving media.

8. An image forming device, comprising:

an image receiving media supply component;

an imaging member;

a media marking unit for forming transferable images on the imaging member;

an opposing member exerting a force on the imaging member to form a transfer nip in which the transferable images formed on the imaging member are transferred to a first surface of an image receiving media substrate introduced into the transfer nip;

a stripping unit, comprising a stripper roller positioned downstream of the transfer nip in a process direction, the stripper roller (1) forming a stripping nip through interaction with the imaging member, and (2) exerting a peeling force on the image receiving media by contact with a second surface of the image receiving media, the second surface of the image receiving media being opposite to the first surface;

a mechanical component that moves the stripper roller between a first position and a second position, the first position being in contact with the imaging member to form the stripping nip and the second position opening contact between the stripper roller and the imaging member; and at least one stripping device in physical contact with the stripper roller downstream of the stripping nip in the process direction to strip the image receiving media from contact with the stripper roller, the at least one stripping device comprising a plurality of stripping ribs interspaced along a span-wise length of the stripper roller.

9. The image forming device of claim 8, the imaging member being an imaging belt, the imaging belt being threaded around an internal pressure roller, and the opposing member being an external pressure roller that is in contact with the imaging belt to form the transfer nip by sandwiching the imaging belt between the internal pressure roller and the external pressure roller.

10. The image forming device of claim 9, the stripper roller having a diameter that is less than a diameter of the internal pressure roller.

11. The image forming device of claim 8, at least a surface of the stripper roller being formed of a material that exerts the peeling force to overcome an adhering force of the image receiving media substrate to the imaging member downstream of the transfer nip in the processing direction.

12. The image forming device of claim 11, the at least the surface of the stripper roller being formed of a silicone material.

13. The image forming device of claim 8, the stripping unit further comprising a pair of exit nipped drive rollers positioned downstream of the at least one stripping device in the process direction to transport the image receiving media.

14. A method for transporting image receiving media in an image forming device, comprising:

forming an image on an imaging member;

contacting the imaging member with an opposing member, the opposing member exerting a force on the imaging member to form a transfer nip in which images formed on the imaging member are transferred to a first surface of an image receiving media substrate introduced into the transfer nip;

contacting the imaging member with a stripper roller positioned downstream of the transfer nip in a process direction to form a stripping nip;

exerting, with the stripper roller, a peeling force on the image receiving media by contact between the stripper roller and a second surface of the image receiving media, the second surface of the image receiving media being opposite to the first surface;

employing a mechanical component to move the stripper roller between a first position and a second position, the first position being in contact with the imaging member to form the stripping nip and the second position opening contact between the stripper roller and the imaging member; and contacting the stripper roller with at least one stripping device downstream of the stripping nip in the process direction to strip the image receiving media from contact with the stripper roller, the at least one stripping device comprising a plurality of stripping ribs interspaced along a span-wise length of the stripper roller.

15. The method of claim 14, the imaging member being an imaging belt, the imaging belt being threaded around an internal pressure roller, and the opposing member being an external pressure roller that is in contact with the imaging belt to form the transfer nip by sandwiching the imaging belt between the internal pressure roller and the external pressure roller.

16. The method of claim 15, the stripper roller having a diameter that is less than a diameter of the internal pressure roller.

17. The method of claim 14, at least a surface of the stripper roller being formed of a material that exerts the peeling force to overcome an adhering force of the image receiving media substrate to the imaging member downstream of the transfer nip in the processing direction.

18. The method of claim 17, the at least the surface of the stripper roller being formed of a silicone material.

19. The method of claim 14, further comprising transporting the image receiving media away from the stripper roller with a pair of exit nipped drive rollers positioned downstream of the at least one stripping device in the process direction.

* * * * *